United States Patent [19]

Bowler, Jr. et al.

[11] 3,989,005

[45] Nov. 2, 1976

[54] OIL METERING BLADE DEVICE

[75] Inventors: Edward F. Bowler, Jr., Webster; Thomas A. Rengert, Macedon, both of N.Y.

[73] Assignee: Xerox Corporation, Stamford, Conn.

[22] Filed: Oct. 29, 1975

[21] Appl. No.: 626,903

[52] U.S. Cl. ..... 118/60; 118/261; 118/637

[51] Int. Cl.[2] ..... B05C 11/04

[58] Field of Search ..... 118/60, 261, 637

[56] References Cited

UNITED STATES PATENTS

| | | | |
|---|---|---|---|
| 3,640,203 | 2/1972 | Raab | 118/261 X |
| 3,718,116 | 2/1973 | Thettu | 118/60 X |
| 3,883,291 | 5/1975 | Cloutier et al. | 118/60 X |
| 3,913,521 | 10/1975 | Bar-on | 118/60 |
| 3,918,400 | 11/1975 | Cheeseman | 118/261 |

FOREIGN PATENTS OR APPLICATIONS

| | | | |
|---|---|---|---|
| 154,579 | 12/1953 | Australia | 118/261 |

*Primary Examiner*—Louis K. Rimrodt

[57] ABSTRACT

An improved oil metering blade device for maintaining a uniform film of oil on the surface of a fuser roll of a heated pressure fusing apparatus for fusing toner images. The blade member is made from any suitable elastic material such as rubber with durometer between 57 and 67 and has a rectangular cross-section. In vicinity where it contacts the fuser roll surface the blade with a radially curved surface of between about 5 to about 20 mils.

5 Claims, 9 Drawing Figures

OIL METERING BLADE DEVICE

This application relates to a heated pressure fusing apparatus used in xerographic copying machines and in particular to an improved oil metering blade device which maintains a uniform oil film on the fuser roll surface to produce high quality copies.

In the practice of xerography is described in U.S. Pat. No. 2,297,691 to Chester F. Carlson a xerographic surface comprising a layer of photoconductive insulating material affixed to a conductive backing is used to support electrostatic images. In the usual method of carrying out the process the xerographic surface is electrostatically charged uniformly across its surface and then exposed to a light pattern of the image being reproduced to thereby discharge the charge in the areas where the light strikes the layer. The undischarged areas of the layer thus form an electrostatic charge pattern in conformity with the configuration of the original light pattern. The latent electrostatic image is developed by contacting it with a finely divided electrostatically attractable powder. The powder is held in image areas by the electrostatic charges on the layer. It is then transferred to a sheet of paper or other suitable surface and affixed thereto to form a permanent print.

A typical device for fixing the toner particles to the sheet is by a heated pressure fusing roll apparatus in which the copy sheet past through the nip of a Teflon coated heated fuser roll and a backup roll as described for example in U.S. Pat. Nos. 3,256,002, 3,268,351 and 3,841,827. In such fusing apparatus care must be taken to remove unwanted toner particles from the heated fuser roll prior to its contact with the copy sheet otherwise the toner particles build up in the face of the fuser roll surface and offset onto the sheet thereby degrading the quality of the copy. In order to prevent or minimize image offset an oil film is applied on the fuser roll surface by an oil dispensing system. In order to achieve a uniform oil film it is desirable to have a metering blade in contact with the fuser roll surface which must be checked periodically to ensure against uneven wear, streaking, etc.

In the past it has been noted that various problems have been caused from the oil metering blade being unable to maintain a uniform film of oil on the fuser roll surface. Thus, if the blade metering assembly does not function properly the level of fuser roll wear increases resulting in expensive replacement thereof. Furthermore, uneven wear on the metering blade results in non-uniform oil film which detracts from the overall quality of the copy sheet where there is evidence of too much oil or too little oil. Too little oil of course, will result in an increased offset problem and too much oil results in oily copy sheets. To cure this problem it is imperative that the oil metering blade maintain uniform contact along the fuser surface to effect a uniform oil film thereon.

It is therefore an object of the present invention to improve oil wetted heated pressure fusing apparatus.

It is another object of the present invention to provide an oil metering blade made of rubber material having a predetermined durometer and shape to effect uniform contact with a roll surface.

It is another object of the present invention to improve the design of an oil metering blade to effect metering an oil wetted fuser roll surface with a uniform oil film thereon.

It is still another object of the present invention to minimize cost and unnecessary maintenance of heated pressure fusing apparatus.

These and other objects of the instant invention are accomplished by a new and improved oil metering blade device which ensures uniform contact to effect an uniform oil film on the fuser roll surface.

Further objects of this invention together with additional features and advantages thereof will become apparent from the following detailed description of the embodiment of the invention when read in conjunction with the accompanying drawings wherein.

Figure 4:
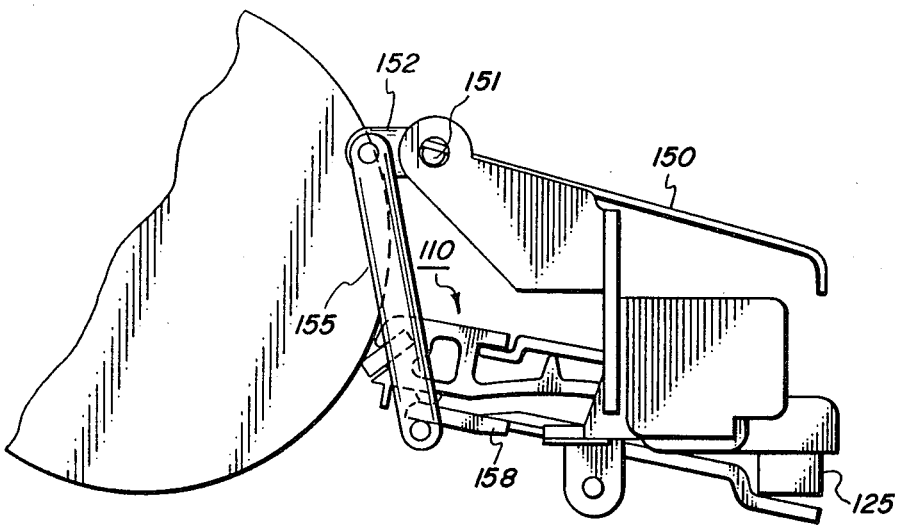
Figure 4:
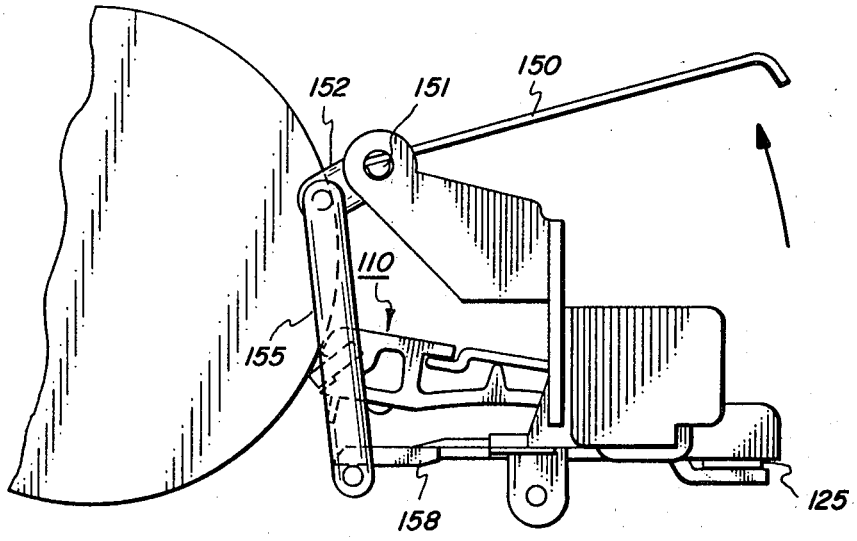
Figure 5:
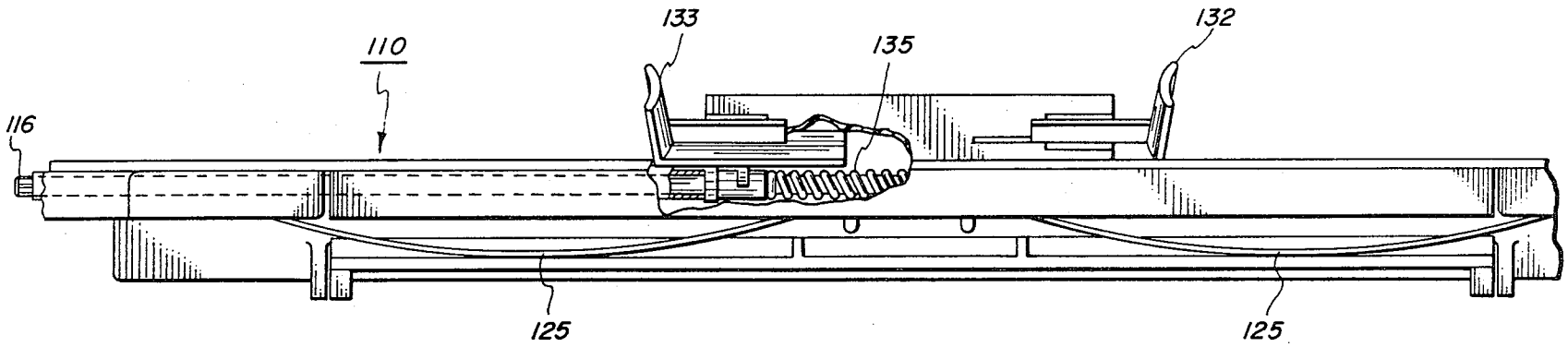
Figure 6:
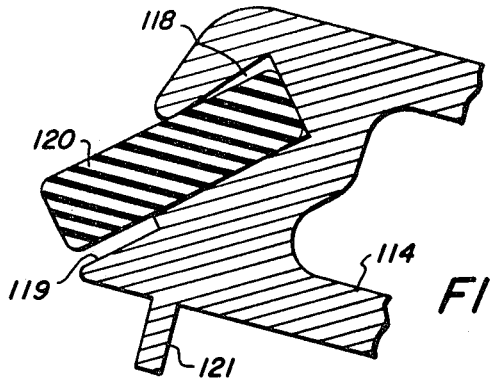
Figure 7:
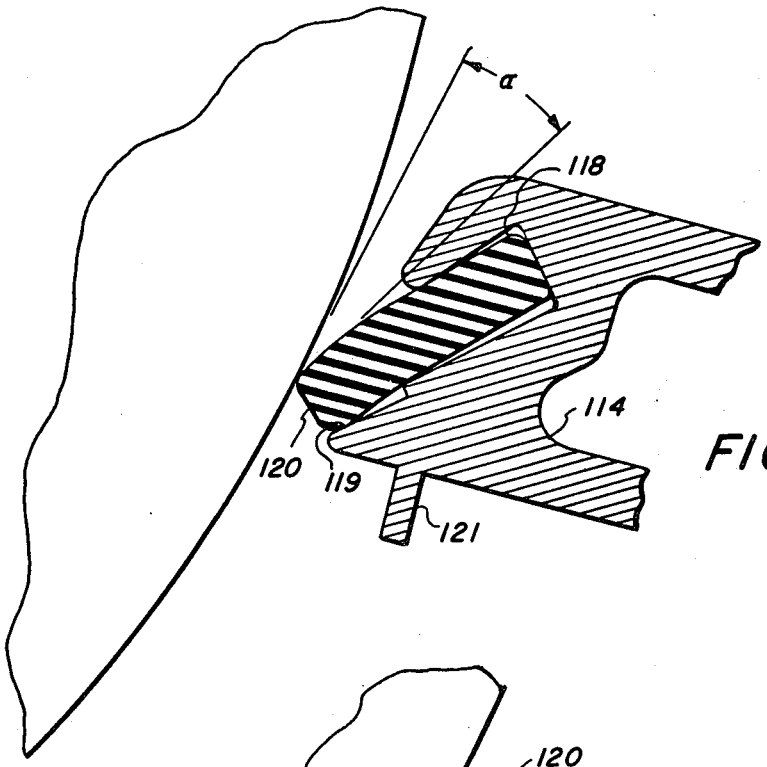
Figure 7A:
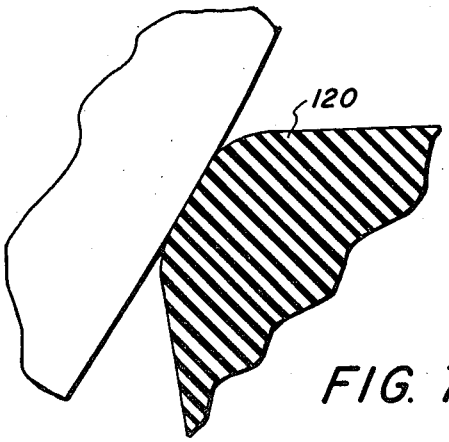

FIGS. 4 and 4*a* are a side sectional views of the blade assembly under load and non-loading conditions, respectively;

FIG. 5 is an end view of the blade holder assembly;

FIG. 6 is a side view of the blade member and blade holder;

FIG. 7 is a side view of the blade member and blade during operating condition;

FIG. 7(a) is exploded view of the blade member of FIG. 7 in the vicinity of the fuser roll surface.

Figure 1:
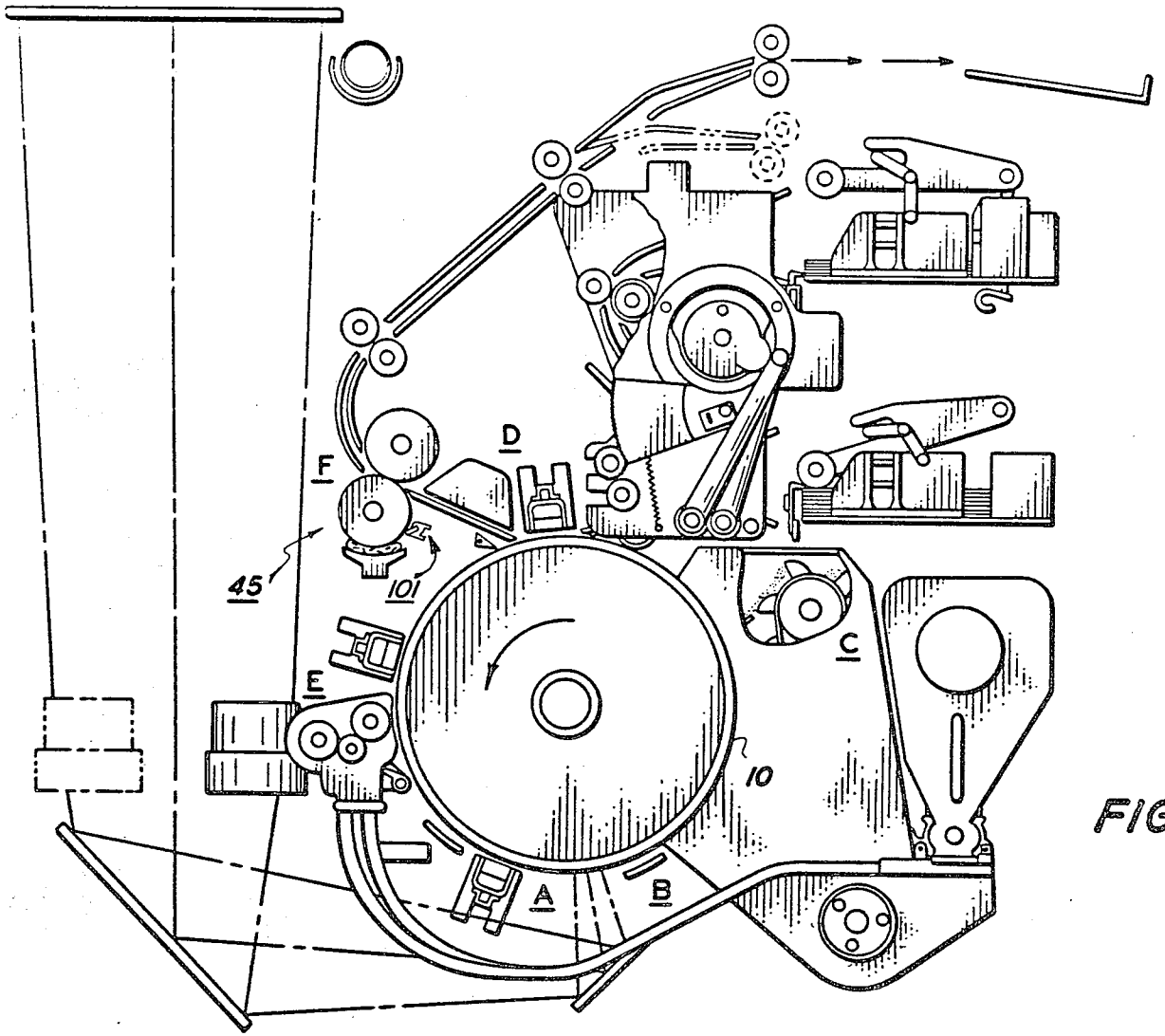
FIG. 1 is a schematic representation of an automatic xerographic reproducing machine incorporating a heated pressure fusing apparatus utilizing an improved oil metering blade device according to the present invention.

Referring now to FIG. 1 of the drawings there is shown an embodiment of the invention in a suitable environment such as an automatic xerographic reproduction machine. The automatic reproducing machine includes a xerographic plate 10 formed in the shape of a drum. The plate has a photoconductive layer or light receiving surface on a conductive backing and is journaled in a frame to rotate in the direction indicated by the arrow. The rotation causes the plate surface to sequentially pass a series of xerographic processing stations. For purpose of the present disclosure the several xerographic processing stations in the path of movement of the plate may be described functionally as follows:

A charging station A where a uniform electrostatic charge is deposited onto the photoconductive plate;

An exposure station B at which a light or radiation pattern of a document to be reproduced is projected onto the plate surface to dissipate the charge in the exposed areas to form a latent electrostatic image of the document to be reproduced;

A developing station C at which xerographic developing material including toner particles having an electrostatic charge opposite to that of the latent electrostatic image is cascaded over the latent electrostatic image to form a powdered image in configuration of a document being reproduced;

A transfer station D at which the powdered image is electrostatically transferred from the plate surface to a transfer material such as paper which is then passed through a heated pressure fusing apparatus which has an improved oil metering blade assembly according to the present invention as will be described more fully hereinafter; and A drum cleaning and discharge station E at which the plate surface is cleaned to remove residual toner particles remaining thereon and to completely discharge any residual electrostatic charge remaining thereon.

For further details of the xerographic processing stations described above, reference is made to U.S. Pat. No. 3,645,615 filed July 3, 1969 and commonly assigned herewith.

Figure 2:
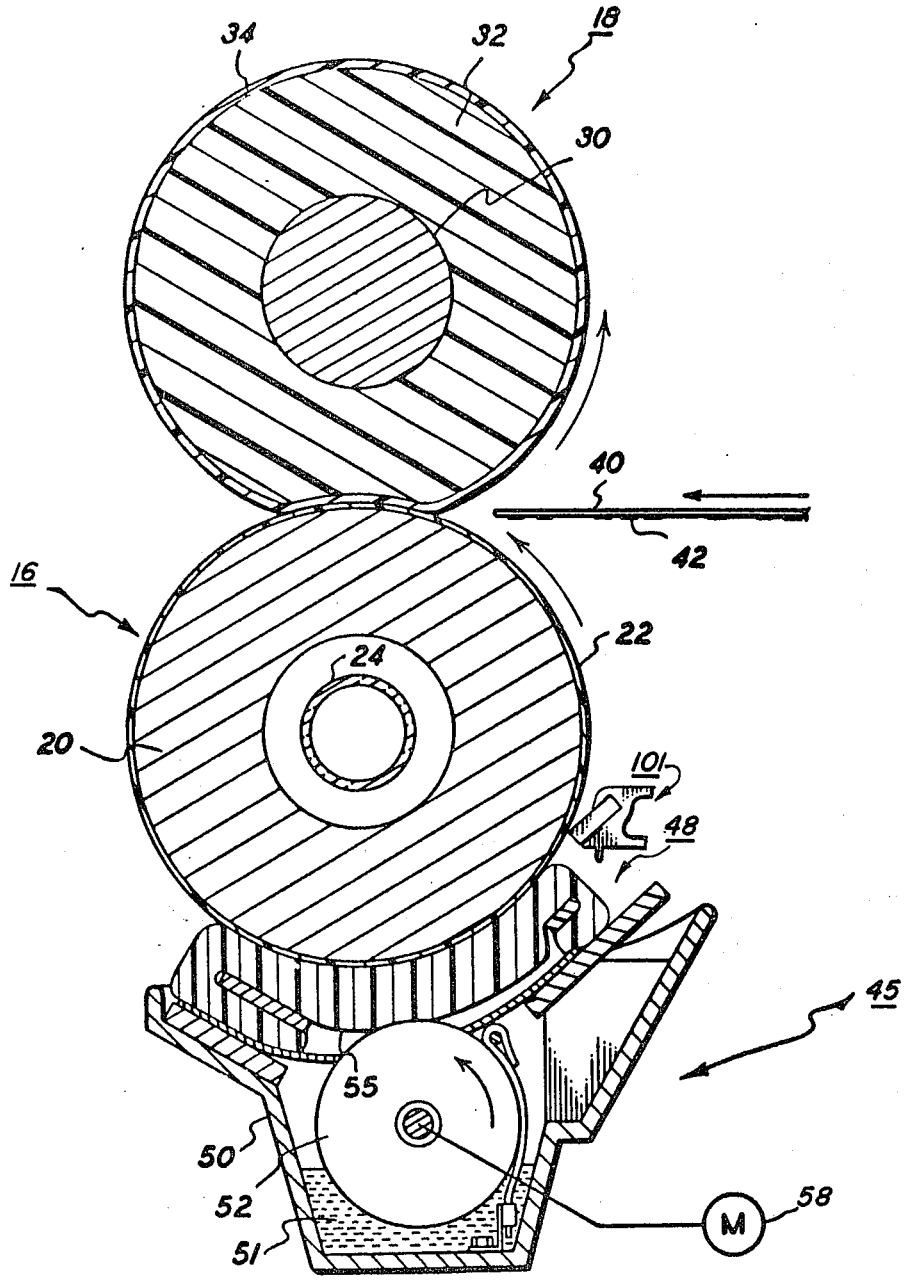
FIG. 2 is a side elevational view of the oil metering blade assembly.
Figure 3:
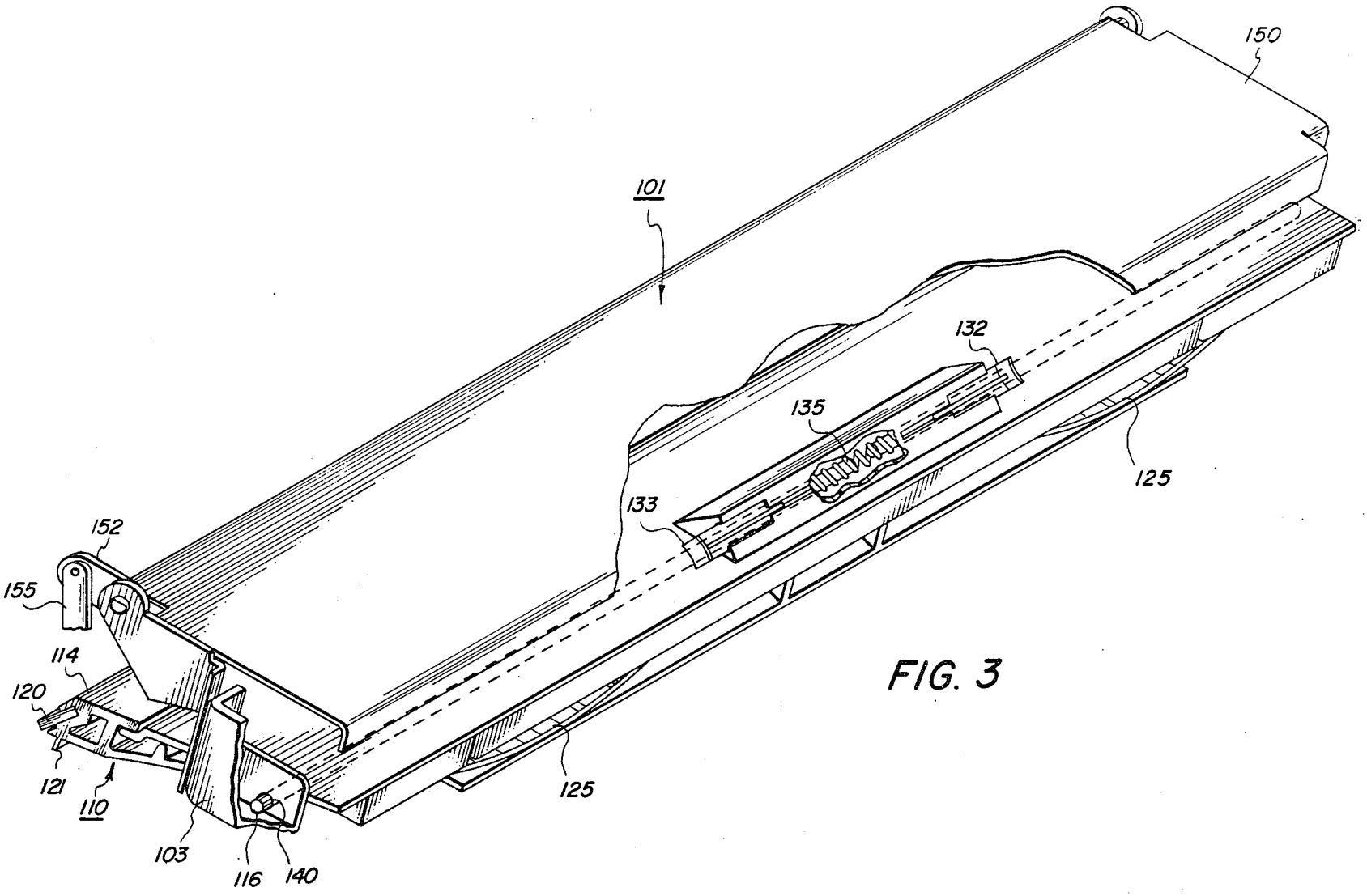
FIG. 3 is an isometric view of the oil metering blade assembly with parts broken away to show details thereof.

Referring now in particular to FIG. 2 there is shown the heated pressure fusing apparatus which includes the improved oil metering blade assembly according to the present invention. The heated pressure fusing apparatus includes a heated fuser roll 16 and a backup or pressure roll 18. The fuser roll is a hollow circular cylinder including a metallic core 20 which is covered with a layer 22 made out of teflon, a trademark of duPont Corporation of Wilmington, Del. The quartz lamp 24 located inside of the fuser roll is a source of thermal energy for the fusing apparatus. Power to the lamp is controlled by a thermal sensor (not shown) which contacts the periphery of the fuser roll as described for example in U.S. Pat. No. 3,357,249. The backup roll is also a circular cylinder and is made up of a metal core 30 surrounded by a thick rubber layer 32 and then by another layer 34 made of Teflon to prevent soaking silicone oil into the layer 32 and subsequent swelling thereof.

When the two rollers 16 and 18 are engaged as shown in FIG. 2 the applied load deforms the rubber in the pressure roll to provide the nip with a finite width. A copy sheet electrostatically bearing the toner images 42 on the underside is brought into contact with the nip of the rolls and with the toner images contacting the fuser roll surface. The mechanism for driving the rolls and for lowering and raising rolls into contact can be accomplished by any suitable means such as that described for example in U.S. Pat. No. 3,291,466 or any suitable mechanical camming device. As a sheet of material is advanced between the rolls 16 and 18 the toner images on a support material are contacted by the peripheral heated surface of the rolls 16 causing the toner images to become tackified which would tend to cause the toner to offset onto the roll except that it is partially prevented from doing so while the Teflon coating on the roll and by the thin film of offset preventing oil which is a silicone oil and is applied to the surface of the roll by an oil dispensing apparatus generally designated 45. Oil dispensing apparatus 45 includes a wicking assembly 48 an oil pan 50 for maintaining a supply of silicone oil 51 and an applicator roll 52 which is driven by an oil dispensing motor 58 during the fusing operation.

Referring now to FIGS. 3–7 in accordance with the present invention an oil metering blade assembly generally designated 101 includes a frame 103 on which is mounted an oil metering blade holder assembly 110. Holder assembly 110 includes blade holder member 114 which is mounted on positioning pins 116 which serve as a pivot axis for pivoting member 114 towards the fuser roll surface. Member 114 is formed with a U-shaped portion 118 for receiving metering blade member 120. U-shaped portion 118 is formed with an undercut portion 119 for a purpose to be described and deflector portion 121 which directs the oil accumulated from the blade member towards wicking assembly 48. It has been found that an acute angle formed between the blade member and a tangent to the fuser roll surface at the point of contact is from about 20° to about 30° and preferably is about 22°.

Blade member 120 is made from any suitable elastic material, such as, rubber having a durometer between about 57 to about 67. A preferred material for blade member 120 is VITON a trademark of duPont Corporation of Wilmington, Del. It will be noted that blade member 120 is formed with a radial curve at each of the four longitudinally extending edges. The radial curve has a radius extending from about 5 to about 20 mils. It has been found that a 10 mil radius works very well when the blade member is loaded under optimum conditions to maintain a uniform oil film sufficient to prevent image offset and to produce high quality copies.

Holder member 114 has undercut portion 119 to enable proper flexing of blade member 120 into uniform contact along the longitudinal extent of the blade member. Thus, any misalignment of the blade member and fuser roll surface is accommodated to achieve a uniform oil film on the fuser roll surface. It has been found that the longitudinal extent of the undercut portion ranges from about 1 to about 1.5 times the blade thickness depending on the modulus of elasticity of the blade member and the thickness thereof. Thus for a blade member made of rubber having a durometer of 62 and having a thickness of ⅛ inch, an undercut portion of 0.015 inches deep and 0.150 inches long works well.

A pair of leaf springs 125 mounted in the frame serves to urge holder assembly 110, blade holder member 114 and blade member 120 into pressure contact with the fuser roll surface by pivoting on an axis through positioning pins 116. Holder assembly 110 is mounted on the same axis with the positioning pins 116 which are retractable by release button 132 and 133 which are connected on the same axis as the positioning pins 116. A coil spring 135 serves to urge the ends of the positioning pins 116 into openings 140 formed in the frame 103. The holder assembly 110 is located below dust shield 150 which is connected to a pivot shaft 151 which is connected to a linkage 152 including push rod 155 which is pinned to a support member 158 through which leaf springs 125 urge the desired loading force on the holder assembly. It will be appreciated that a single point loading is effected to achieve uniform contact of the blade member with the fuser roll surface. It will be further appreciated that the lower the force necessary to achieve blade member to fuser roll surface contact the more uniform the contact pressure will be in the blade nip.

Upon raising shield 150 tension on springs 125 are released. To remove the holder assembly 110 release buttons 132 and 133 are gripped with the thumb and forefinger compressing spring 135 enabling the positioning pins 116 to be released from the openings 140 and the holder assembly removed from the frame. This enables the blade member to be examined for wear and repositioning or replacement thereof.

While the invention has been described with reference to the structure disclosed, it is not confined to the details set forth, but is intended to cover such modifications or changes as may come within the scope of the following claims.

What is claimed is:

1. In an oil wetted heated pressure roll fusing apparatus for fusing toner images to copy sheets produced from a xerographic copying machine, an improved oil metering blade device comprising:

a frame, a blade holder assembly positioned on said frame, including a U-shaped blade holding member which is pivotable on an axis, an elongated blade member made of a rubber material having a durometer ranging from 57 to about 67 received in said blade holding member and positioned in contact with an oil wetted fuser roll surface to effect a uniform oil thereon, spring means for applying a loading force about said axis on said blade holding member and blade member against said fuser roll surface, said blade member having at least one longitudinally extending portion shaped as a radially curved surface where it contacts said fuser roll surface.

2. Apparatus according to claim 1 wherein the radius of said curved surface ranges from about 5 to about 20 mils.

3. Apparatus according to claim 2 wherein said radius is about 10 mils.

4. Apparatus according to claim 1 wherein said blade member has a generally rectangular cross-section.

5. Apparatus according to claim 4 wherein said blade member has a radially curved shape formed on a plurality of the longitudinally extending portions thereof.

* * * * *